US007438255B2

(12) United States Patent
Burnett

(10) Patent No.: US 7,438,255 B2
(45) Date of Patent: Oct. 21, 2008

(54) SUSPENDED TOILET TISSUE ROLL HOLDER WITH AUXILIARY TOILET TISSUE

(76) Inventor: Allen Garrett Burnett, 3184 Rock Creek Dr., Rex, GA (US) 30273-2440

( * ) Notice: Subject to any disclaimer, the term of this patent is extended or adjusted under 35 U.S.C. 154(b) by 231 days.

(21) Appl. No.: 11/477,316

(22) Filed: Jun. 29, 2006

(65) Prior Publication Data

US 2008/0001018 A1 Jan. 3, 2008

(51) Int. Cl.
*B65H 75/18* (2006.01)

(52) U.S. Cl. ..... 242/597.5; 242/599.3; 242/599.4

(58) Field of Classification Search ..... 242/597, 242/597.1, 597.5, 597.6, 597.8, 599.3, 599.4; D6/520, 521, 522, 523
See application file for complete search history.

(56) References Cited

U.S. PATENT DOCUMENTS 1,292,640 A * 1/1919 Phelps ..... 242/597
2,419,798 A * 4/1947 Stone ..... 242/597.5
2,518,328 A * 8/1950 Janonis ..... 242/597.5
2,801,809 A * 8/1957 Glaner ..... 242/599.3
D277,347 S * 1/1985 Thompson ..... D6/523
5,100,075 A * 3/1992 Morand ..... 242/597.5
D452,789 S * 1/2002 Zetsche ..... D6/523
D477,481 S * 7/2003 Ouano ..... D6/523

* cited by examiner

*Primary Examiner*—William A Rivera

(57) ABSTRACT

A wall mounted holder to support a standard toilet tissue roll, and within a suspended hollow axle contain an auxiliary tissue roll. The suspended axle dynamically alters position dependent upon the outside diameter of the supported standard toilet tissue roll. The suspended axle has means for manipulation of the supported standard toilet tissue roll and the contained auxiliary tissue roll. The axle outer diameter is slightly less than the inner diameter of the supported standard toilet tissue roll center tube. The hollow compartment of the axle provides the maximum space for the auxiliary tissue roll. Auxiliary tissue is tightly rolled and contained in the hollow compartment of the axle.

20 Claims, 5 Drawing Sheets

SUSPENDED TOILET TISSUE ROLL HOLDER WITH AUXILIARY TOILET TISSUE

RELATED APPLICATIONS

Applicant filed patent application Ser. No. 11/182,978 on Jul. 15, 2005 for a Toilet Tissue Roll Holder Axle With Auxiliary Tissue. The present application is similar in nature to that pending application in having a compartment for storing auxiliary toilet tissue.

Applicant filed patent application Ser. No. 11/357,571 on Feb. 17, 2006 for a Wall Mount Toilet Tissue Roll Holder With Auxiliary Tissue. The present application is similar in nature to that pending application in being wall mounted and having a compartment for storing auxiliary toilet tissue.

Applicant filed patent application Ser. No. 11/395,037 on Mar. 31, 2006 for a Wall Mount Mechanical Toilet Tissue Roll Holder With Auxiliary Tissue. The present application is similar in nature to that pending application in being wall mounted and having a compartment for storing auxiliary toilet tissue.

Applicant filed patent application Ser. No. 11/406,539 on Apr. 19, 2006 for a Pivoting Toilet Tissue Roll Holder With Auxiliary Tissue. The present application is similar in nature to that pending application in being wall mounted and having a compartment for storing auxiliary toilet tissue.

Applicant filed a patent application on Jun. 28, 2006 for a Toilet Tissue Roll Holder Spindle With Auxiliary Toilet Tissue. The present application is similar in nature to that pending application in having a compartment for storing auxiliary toilet tissue.

FIELD OF THE INVENTION

The present invention relates to toilet tissue holders and, more particularly, to a wall mounted, suspended axle, toilet tissue roll holder with a compartment for auxiliary toilet tissue.

BACKGROUND OF THE INVENTION

Since the invention of indoor plumbing, people have occasionally been stranded on a toilet without toilet tissue because they did not realize there was very little, or none at all nearby when they took a seat. Using whatever alternative material was within reach, moving awkwardly around the restroom area searching for toilet tissue, or calling for help were a few of the available remedies.

Standard toilet tissue rolls are manufactured with varying outside diameters. Permanently mounted, standard toilet tissue roll holders designed to accommodate the largest outside diameter products protrude into the restroom space needlessly when fitted with smaller outside diameter, or depleted standard toilet tissue rolls.

the out-of-tissue situation can be solved by a toilet tissue roll holder with a space for auxiliary toilet tissue. Since standard toilet tissue rolls designed for home use have a universal length and inside diameter, that space should set the standard for an auxiliary tissue size.

The bathroom space intrusion situation can be solved by facilitating the automatic mechanical adjustment of the total dimension of a standard toilet tissue roll holder plus the mounted standard toilet tissue roll, relative to the mounting surface behind the device, dependent upon the outside diameter of the mounted standard toilet tissue roll.

The invention is a wall mounted toilet tissue roll holder. The invention has a hollow compartment inside a suspended axle where an auxiliary toilet tissue roll is stored. The suspended axle is free to adjust automatically, relative to the mounting surface behind the device, dependent upon the outside diameter of the standard toilet tissue roll.

An amount of toilet tissue necessary for only a single user is required when discovery of an inadequate or depleted supply of toilet tissue is made at an inopportune time. The invention provides at least that amount of auxiliary toilet tissue by maximizing the size of the storage space relative to the inside diameter of standard toilet tissue rolls.

The auxiliary toilet tissue roll of the invention can be removed and the hollow compartment used instead to store other personal hygiene products or other items sometimes required when utilizing a toilet, and no other close or discreet storage location is available.

Most standard toilet tissue roll holders have spindles much smaller than the center tube of standard toilet tissue rolls causing wobbling when unrolling. The invention has an axle only slightly smaller than the center tube of standard toilet tissue rolls and provides a smooth unrolling action.

Devices to house additional standard toilet tissue rolls in the proximity of a toilet can be found in great number.

Small packages of all sorts of tissue types can be found in great number.

Small rolls of tissue, and dispensers for those rolls are produced for camping or other portable purposes.

The need to solve the problem of running out of toilet tissue while utilizing a toilet is long established. U.S. Pat. No. 2,801,809 filed May 6, 1954 and issued Aug. 6, 1957 to L. O. Glaner addressed the problem.

U.S. Pat. No. 5,255,861 issued Oct. 26, 1993 to Saul Lerner also addressed the problem.

Five previous Patent Applications filed by this applicant provide for auxiliary toilet tissue rolls also addressed the problem.

Primary, wall mounted holders for the use of standard toilet tissue rolls, and devices for storage of additional standard toilet tissue rolls, when empty, require replenishment of their supply of standard toilet tissue roll or rolls. They have no provision for a smaller auxiliary amount of toilet tissue when inevitably the need for replenishment is overlooked or ignored.

Camping and other portable-need toilet tissue products are designed for an outdoor application, are large as designed for several uses, and have no capability to be included conveniently in the indoor restroom environment.

The device in U.S. Pat. No. 2,801,809 to Glaner long ago recognized the best location for an auxiliary tissue supply as being the interior of the center tube of a standard toilet tissue roll, and more specifically inside the spindle of a holder. But the Glaner device claims cite the device as being a spindle for turning, for turning movement, and rotatably supporting the spindle. There is no provision to assemble the device without trunions, springs and other parts specific to a spindle. There is no provision to automatically adjust the location of the spindle relative to the mounting surface and the outside dimension of a standard toilet tissue roll. Glaner is a rotating, spring-held spindle for use in a specific type and specific size of holder. There are no provisions for automatic size adjustment determined by the outside dimension of a mounted standard toilet tissue roll.

The device in U.S. Pat. No. 5,255,861 to Lerner also recognizes the best location for an auxiliary tissue supply as inside the tube of a toilet tissue roll. There is no provision to automatically adjust the location of the spindle relative to the mounting surface and the outside dimension of a standard toilet tissue roll. Lerner is a tissue roll for use with a specific type spindle and a specific size of holder. There are no provisions for automatic size adjustment determined by the outside dimension of a mounted standard toilet tissue roll.

None of the five previous Patent Applications filed by this applicant provide for automatic size adjustment determined by the outside dimension of the mounted standard toilet tissue roll.

SUMMARY OF EMBODIMENTS OF THE INVENTION

In accordance with the present invention, there is provided a wall mounted, movably suspended axle to support a standard toilet tissue roll. Within the axle in a hollow compartment an auxiliary tissue roll is contained. Movable action of the suspended axle causes the standard toilet tissue roll to remain close to the mounting surface behind the invention so to always present the smallest combined depth. The axle outer diameter is slightly less than the inner diameter of the standard toilet tissue roll's center tube, allowing the hollow compartment of the axle to provide the maximum space for the auxiliary tissue roll. The auxiliary tissue roll is tightly wound and contained in the hollow compartment of the axle.

It is an object of the invention to provide a permanently affixed device capable of suspending a hollow axle to store an auxiliary tissue roll in close proximity to those who did not realize there was an inadequate supply of toilet tissue at their disposal before circumstances prevented them from moving about comfortably beyond the immediate area of a toilet they were utilizing.

It is another object of the invention to provide a permanently affixed device for dispensing a standard toilet tissue roll.

It is another object of the invention to provide a dispenser for a standard toilet tissue roll that automatically alters position relative to the outside diameter of the standard toilet tissue roll.

It is another object of the invention to provide an auxiliary tissue roll of a certain size to fit into the storage area of the invention.

It is another object of the invention to provide a storage location for personal hygiene supplies or other items in a permanent, fixed position within an arm's reach of a toilet.

It is another object of the invention to provide an auxiliary tissue roll of a size that can be transported on one's person discreetly.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF EMBODIMENTS OF THE INVENTION

Ideally, someone discovering an inadequate or depleted supply of standard toilet tissue after beginning their use of a toilet, would have access to an auxiliary supply of toilet tissue within an arm's length of that toilet which would be less prone to outages.

The out-of-tissue situation can be solved by a toilet tissue roll holder with a space for auxiliary toilet tissue. Since standard toilet tissue rolls designed for home use have a universal length and inside diameter, that space should set the standard for an auxiliary tissue size.

The bathroom space intrusion situation can be solved by facilitating the automatic mechanical adjustment of the total dimension of a standard toilet tissue roll holder plus the mounted standard toilet tissue roll, relative to the mounting surface behind the device, dependent upon the outside diameter of the mounted standard toilet tissue roll.

The invention is a wall mounted toilet tissue roll holder. The invention has a hollow compartment inside a suspended axle where an auxiliary toilet tissue roll is stored. The suspended axle is free to adjust automatically, relative to the mounting surface behind the device, dependent upon the outside diameter of the standard toilet tissue roll.

An amount of toilet tissue necessary for only a single user is required when discovery of an inadequate or depleted supply of toilet tissue is made at an inopportune time. The invention provides at least that amount of auxiliary toilet tissue by maximizing the size of the storage space relative to the inside diameter of standard toilet tissue rolls.

The auxiliary toilet tissue roll of the invention can be removed and the hollow compartment used instead to store other personal hygiene products or other items sometimes required when utilizing a toilet, and no other close or discreet storage location is available.

Most standard toilet tissue roll holders have spindles much smaller then the center tube of standard toilet tissue rolls causing wobbling when unrolling. The invention has an axle only slightly smaller than the center tube of standard toilet tissue rolls and provides a smooth unrolling action.

Figure 1:
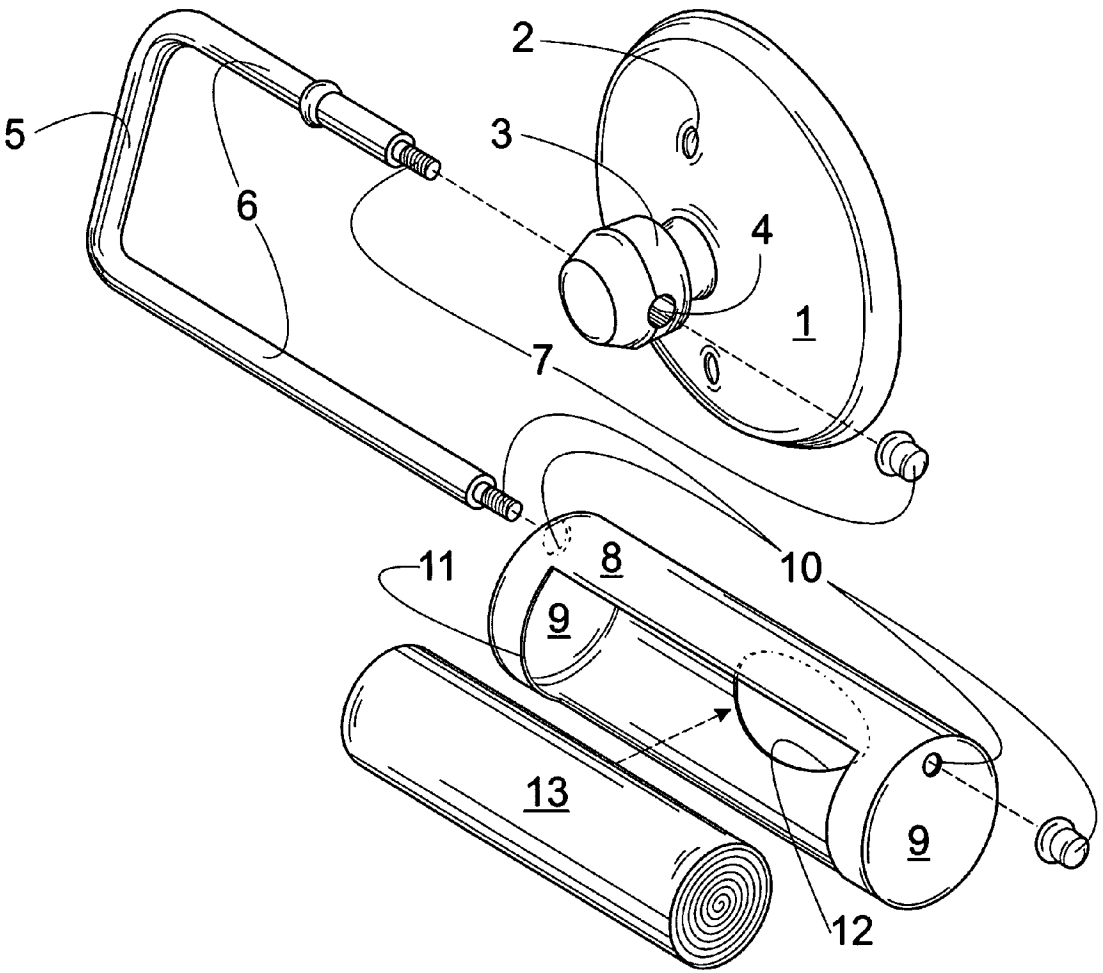
FIG. 1 is an exploded perspective view of a suspended toilet tissue roll holder with auxiliary toilet tissue in accordance with the invention.

FIG. 1 is an exploded perspective view of a suspended toilet tissue roll holder with auxiliary toilet tissue in accordance with the invention.

A base plate 1 is made of plastic, metal, wood or other suitable material. The base plate 1 can be constructed as one piece or as multiple pieces. The base plate 1 establishes contact with, and alignment to, a wall or other mounting surface. The base plate 1 is attached to the wall or other mounting surface using a mounting device 2. In this embodiment the mounting device 2 is visible holes for screws. The mounting device 2 can be mechanical, adhesive or other suitable systems. The mounting device 2 can be visible or hidden.

A post 3 is made of plastic, metal, wood or other suitable material. The post 3 can be constructed as one piece or as multiple pieces. The post 3 extends from the base plate 1 to provide a position for a pivot device 4. The pivot device 4 provides a rotational axis for suspension. In this embodiment the pivot device 4 is a hole thru the post 3 parallel to the base plate 1. The pivot device 4 can be mechanical or other suitable systems. The pivot device 4 can be visible or hidden.

A bail 5 is made of plastic, metal, wood or other suitable material. The bail 5 can be constructed as one piece or as multiple pieces. A bail arm 6 attaches to the post 3 utilizing the pivot device 4 to establish suspension of the bail 5. A bail retaining device 7 secures the bail 5 to the post 3. In this embodiment the bail retaining device 7 is a threaded end on the attached bail arm 6 and a threaded cap fastened to the threaded end of the attached bail arm 6. The bail retaining device 7 can be mechanical, adhesive or other suitable systems. The bail retaining device 7 can be visible or hidden.

An axle 8 is made of plastic, metal, wood or other suitable material. The axle 8 can be constructed as one piece or as multiple pieces. The axle 8 is hollow. An axle end 9 encloses the ends of the axle 8. The axle end 9 is made of plastic, metal, wood or other suitable material. The axle end 9 can be constructed as one piece or as multiple pieces. The axle 8 connects to the suspended bail arm 6 at the axle end 9. Connection of the axle end 9 to the suspended bail arm 6 is accomplished with a mounting system 10. In this embodiment the mounting system 10 is holes in the axle end 9 for the suspended bail arm 6 to pass thru, a threaded end on the suspended bail arm 6, and a threaded cap fastened to the threaded end of the suspended bail arm 6. The mounting system 10 can be mechanical, adhesive, or other suitable system. The mounting system 10 can be visible or hidden.

An access opening 11 exists for object insertion and object extraction relative the space defined by the axle 8 and the axle end 9 . The access opening 11 can be visible or hidden. The access opening 11 can be in the axle 8 or in the axle end 9. In this embodiment the access hole is in the axle 8 and opposite the wall or other mounting surface. A finger hole 12 exists for additional access to the space defined by the hollow axle 8 and the axle end 9 to manipulate contents there. The finger hole 12 can be in the axle 8 or in the axle end 9. In this embodiment the finger hole 12 hole is in the axle 8 and opposite the access opening 11.

An auxiliary tissue roll 13 is made of tightly wound toilet tissue. The auxiliary tissue roll 13 is stored within the space defined by the hollow axle 8 and the axle end 9. The access opening 11 is of sufficient size to allow the insertion and extraction of the auxiliary tissue roll 13. The finger hole 12 is of sufficient size to contain the auxiliary tissue roll 13 while allowing extraction of the auxiliary tissue roll 13 to be accomplished by insertion of a finger or fingers thru the finger hole 12 and forcing the auxiliary tissue roll 13 thru the access opening 11.

Figure 2:
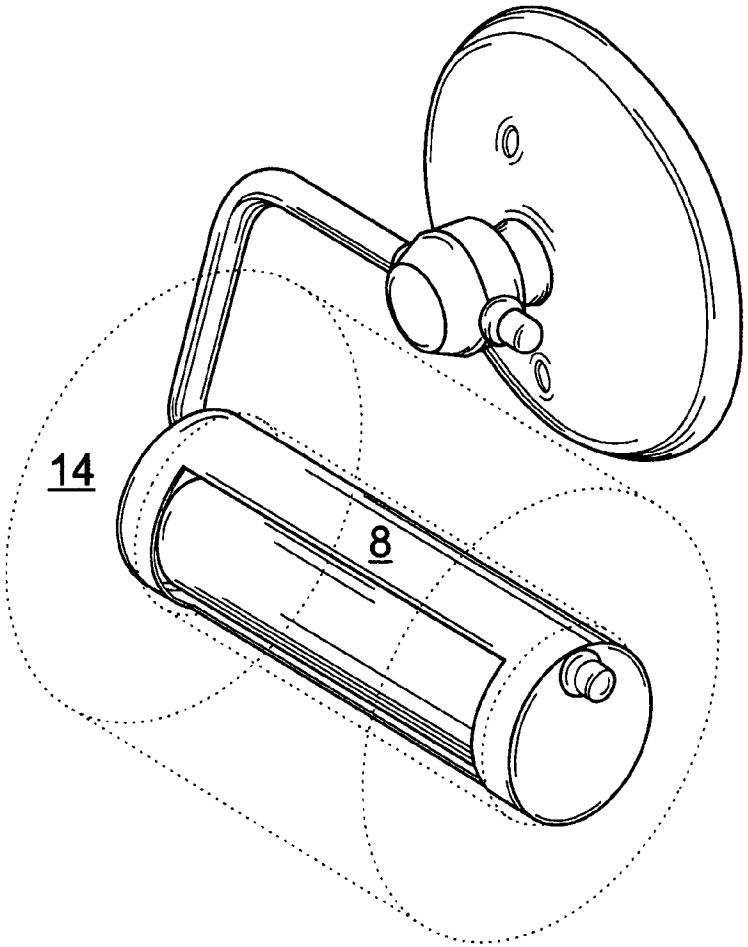
FIG. 2 is a perspective view of a suspended toilet tissue roll holder with auxiliary toilet tissue in accordance with the invention supporting a toilet tissue roll.

FIG. 2 is an assembled perspective view of a suspended toilet tissue roll holder with auxiliary toilet tissue in accordance with the invention. The axle 8 supports a standard toilet tissue roll 14. The axle 8 outside diameter is slightly smaller than the inside diameter of the center tube of a standard toilet tissue roll 14. The axle 8 length is slightly longer than the width of the standard toilet tissue roll 14.

Figure 3:
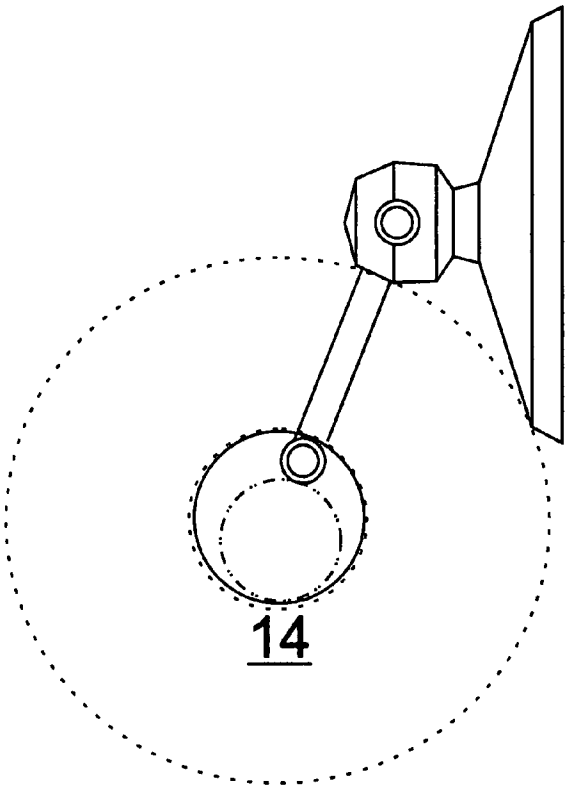
FIG. 3 is a right elevation view of a suspended toilet tissue roll holder in accordance with the invention in an extended position supporting a large outside diameter, toilet tissue roll.

FIG. 3 is a right elevation of a suspended toilet tissue roll holder with auxiliary toilet tissue in accordance with the invention in an extended position supporting a large outside diameter, standard toilet tissue roll 14.

Figure 4:
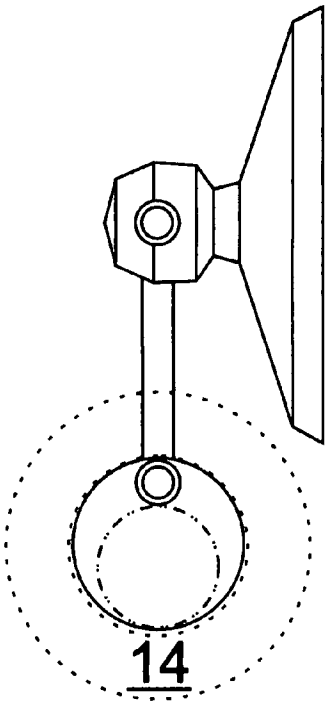
FIG. 4 is a right elevation view of a suspended toilet tissue roll holder in accordance with the invention in an unextended position supporting a small outside diameter, toilet tissue roll.

FIG. 4 is a right elevation of a suspended toilet tissue roll holder with auxiliary toilet tissue in accordance with the invention in an unextended position supporting a small outside diameter, standard toilet tissue roll 14.

Figure 5:
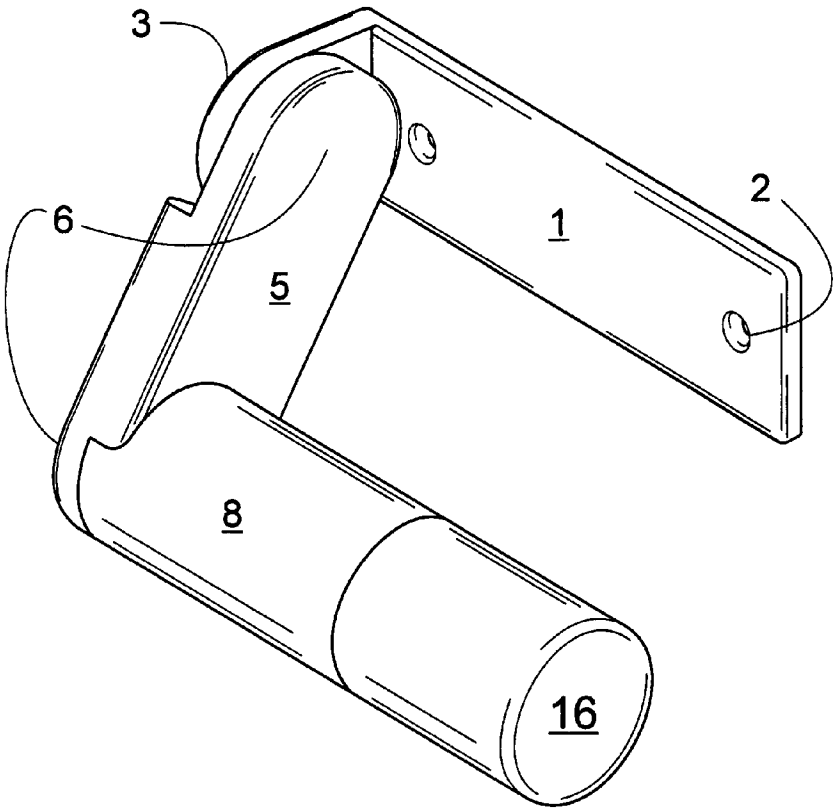
FIG. 5 is a perspective view of a variant embodiment of a suspended toilet tissue roll holder with auxiliary toilet tissue in accordance with the invention.

FIG. 5 is a perspective view of a variant embodiment of a suspended toilet tissue roll holder with auxiliary toilet tissue in accordance with the invention in a partially extended position.

A base plate 1 is made of plastic, metal, wood or other suitable material. The base plate 1 can be constructed as one piece or as multiple pieces. The base plate 1 establishes contact with, and alignment to, a wall or other mounting surface. The base plate 1 is attached to the wall or other mounting surface using a mounting device 2. In this variant embodiment the mounting device 2 is visible holes for screws. The mounting device 2 can be mechanical, adhesive or other suitable systems. The mounting device 2 can be visible or hidden.

A post 3 is made of plastic, metal, wood or other suitable material. The post 3 can be constructed as one piece or as multiple pieces. The post 3 extends from the base plate 1.

A bail 5 is made of plastic, metal, wood or other suitable material. The bail 5 can be constructed as one piece or as multiple pieces. In this variant embodiment the bail arm 6 attaches to the post 3 to establish suspension of the bail 5.

An axle 8 is made of plastic, metal, wood or other suitable material. The axle 8 can be constructed as one piece or as multiple pieces. The axle 8 is hollow.

A slip cap 16 is attached to the axle 8.

Figure 6:
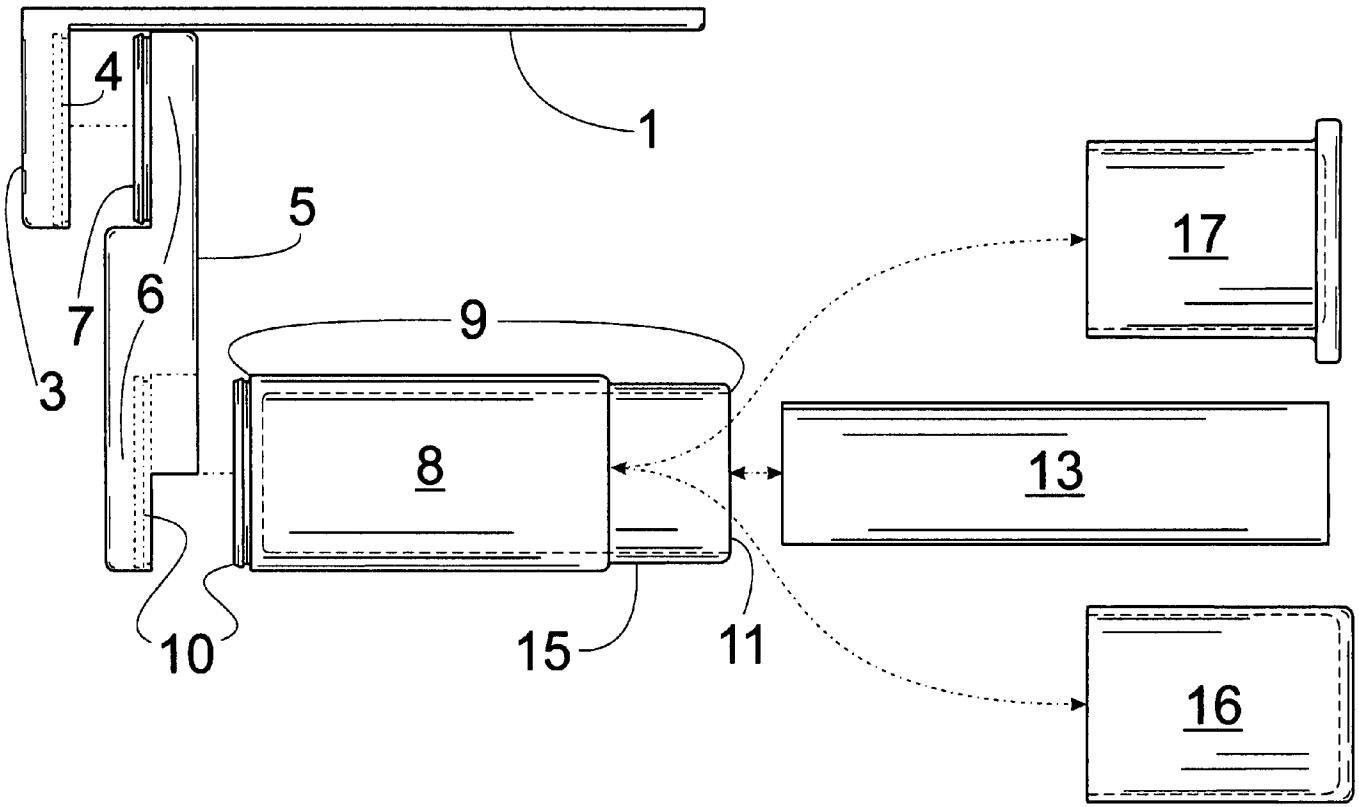
FIG. 6 is an exploded top view of a variant embodiment of a suspended toilet tissue roll holder with auxiliary toilet tissue in accordance with the invention.

FIG. 6 is an exploded top view of a variant embodiment of a suspended toilet tissue roll holder with auxiliary toilet tissue in accordance with the invention.

The post 3 provides a position for a pivot device 4. The pivot device 4 provides a rotational axis for suspension. In this variant embodiment the pivot device 4 is a ridged hole partially extending thru the post 3 parallel to the base plate 1. The pivot device 4 can be mechanical or other suitable systems. The pivot device 4 can be visible or hidden.

A bail retaining device 7 secures the bail 5 to the post 3 at the pivot device 4. In this variant embodiment the bail retaining device 7 is a beveled, elevated disc on the attached bail arm 6. The bail retaining device 7 snaps into the post 3 at the pivot device 4 for retention. The bail retaining device 7 can be mechanical, adhesive or other suitable systems. The bail retaining device 7 can be visible or hidden.

The axle 8 connects to the suspended bail arm 6 at an axle end 9. Connection of the axle end 9 to the suspended bail arm 6 is accomplished with a mounting system 10. In this variant embodiment the mounting system 10 is a ridged hole partially extending thru the suspended bail arm 6, and a beveled, elevated disc on the axle end 9. The beveled, elevated disc on the axle end 9 snaps into the ridged hole on the suspended bail arm 6 for connection. The mounting system 10 can be mechanical, adhesive, or other suitable systems. The mounting system 10 can be visible or hidden.

In this variant embodiment the access opening 11 is in the axle end 9 opposite the mounting system 10.

The axle 8 has a reduced diameter cap slide 15 adjacent the axle end 9 where the access opening 11 is located. The cap slide 15 allows the slip cap 16 or an optional keeper cap 17 to be attached to the axle 8. The slip cap 16 retains the auxiliary tissue roll 13 within the axle 8. The slip cap 16 will allow toilet tissue rolls to be slipped on to and off of the axle 8. The optional keeper cap 17 retains the auxiliary tissue roll 13. The keeper cap 17 will retain a mounted toilet tissue roll.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A suspended toilet tissue roll holder with auxiliary toilet tissue for providing auxiliary tissue at a toilet, comprising:

a base plate for establishing contact and alignment with a mounting surface;

means for securing the base plate to the mounting surface, connected to the base plate;

means for providing a pivot device position relative to the base plate, fastened to the base plate;

means for providing a rotational axis for suspension, directly formed to said means for providing the pivot device position relative to the base plate;

means for suspending an axle from the means for providing the pivot device position relative to the base plate, inserted into said means for providing the rotational axis for suspension;

means for securing the means for suspending the axle from the means for providing the pivot device position to the means for providing the pivot device position relative to the base plate, attached to said means for suspending the axle from the means for providing the pivot device position relative to the base plate, and moveably engaged to said means for providing the pivot device position relative to the base plate;

means for containing an auxiliary tissue roll, and for supporting an outer toilet tissue roll;

means for attaching the means for suspending the axle from the means for providing the pivot device position relative to the base plate to the means for containing the auxiliary tissue roll;

means for connecting the means for containing the auxiliary tissue roll engaged to said means for suspending the axle from the means for providing the pivot device position;

means for object insertion into, and object extraction from said means for containing the auxiliary tissue roll; and the auxiliary toilet tissue, configured to be inserted to said means for containing the auxiliary tissue roll.

2. The suspended toilet tissue roll holder with auxiliary toilet tissue in accordance with claim 1, wherein said base plate for establishing contact and alignment with the mounting surface comprises a substantially flat base plate.

3. The suspended toilet tissue roll holder with auxiliary toilet tissue in accordance with claim 1, wherein said means for securing the base plate to the mounting surface comprises one of a mechanical or an adhesive mounting device.

4. The suspended toilet tissue roll holder with auxiliary toilet tissue in accordance with claim 1, wherein said means for providing the pivot device position relative to the base plate comprises a post.

5. The suspended toilet tissue roll holder with auxiliary toilet tissue in accordance with claim 1, wherein said means for providing the rotational axis for suspension comprises a pivot device.

6. The suspended toilet tissue roll holder with auxiliary toilet tissue in accordance with claim 1, wherein said means for suspending the axle from the means for providing the pivot device position comprises a bail.

7. The suspended toilet tissue roll holder with auxiliary toilet tissue in accordance with claim 1, wherein said means for means for securing the means for suspending the axle from the means for providing the pivot device position to the means for providing the pivot device position relative to the base plate comprises one of a mechanical or an adhesive bail retaining device.

8. The suspended toilet tissue roll holder with auxiliary toilet tissue in accordance with claim 1, wherein said means for containing the auxiliary tissue roll comprises a hollow axle.

9. The suspended toilet tissue roll holder with auxiliary toilet tissue in accordance with claim 1, wherein said means for attaching the means for suspending the axle from the means for providing the pivot device position relative to the base plate to the means for containing the auxiliary tissue roll comprises an axle end.

10. The suspended toilet tissue roll holder with auxiliary toilet tissue in accordance with claim 1, wherein said means for connecting the means for containing the auxiliary tissue roll comprises one of a mechanical or an adhesive mounting system.

11. The suspended toilet tissue roll holder with auxiliary toilet tissue in accordance with claim 1, wherein said means for object insertion into, and the object extraction from said means for containing the auxiliary tissue roll comprises an access opening.

12. The suspended toilet tissue roll holder with auxiliary toilet tissue in accordance with claim 1, wherein the auxiliary toilet tissue comprises a tightly wound auxiliary tissue roll.

13. A suspended toilet tissue roll holder with auxiliary toilet tissue for providing auxiliary tissue at a toilet, comprising:

a substantially flat base plate, for establish contact and alignment with a mounting surface;

one of a mechanical or an adhesive mounting device, for securing the substantially flat base plate to the mounting surface, connected to said base plate;

a post, for providing a pivot device position relative to the substantially flat base plate, fastened to said substantially flat base plate;

a pivot device, for providing a rotational axis for suspension, coupled to said post;

a bail, for suspending an axle from the pivot device, rotatably inserted to said pivot device;

one of a mechanical or an adhesive bail retaining device, for securing the bail the post at the pivot device;

a hollow axle, for containing the auxiliary tissue, and for supporting an outer toilet tissue roll;

an axle end, for attaching the bail to the hollow axle, connected to said bail;

one of a mechanical or an adhesive, mounting system, for connecting the axle end to the bail, attached to said axle end, and engaged to said bail; and an access opening, for object insertion into, and object extraction from the hollow axle.

14. The suspended toilet tissue roll holder with auxiliary toilet tissue as recited in claim 13, further comprising: a finger hole, for access to an interior of the hollow axle, formed to said hollow axle.

15. The suspended toilet tissue roll holder with auxiliary toilet tissue as recited in claim 14, further comprising: a slip cap for retaining the auxiliary tissue.

16. The suspended toilet tissue roll holder with auxiliary toilet tissue as recited in claim 14, further comprising: a keeper cap for retaining the auxiliary tissue.

17. The suspended toilet tissue roll holder with auxiliary toilet tissue as recited in claim 13, further comprising: a cap slide, formed to said hollow axle.

18. The suspended toilet tissue roll holder with auxiliary toilet tissue as recited in claim 13, further comprising: a slip cap for retaining the auxiliary tissue.

19. The suspended toilet tissue roll holder with auxiliary toilet tissue as recited in claim 13, further comprising: a keeper cap for retaining the auxiliary tissue.

20. A suspended toilet tissue roll holder with auxiliary toilet tissue for providing auxiliary tissue at a toilet, comprising:

a substantially flat base plate, for establishing contact and alignment with a mounting surface;

one of a mechanical or and adhesive mounting device for securing the substantially flat base plate to the mounting surface;

a post, for providing a pivot device position relative to the substantially flat base plate, fastened to said substantially flat base plate;

a pivot device, for providing a rotational axis for suspension, formed to said post;

a bail, for suspending an axle from the pivot device, rotatably inserted to said pivot device;

one of a mechanical or an adhesive bail retaining device, for securing the bail on the post at the pivot device, attached to said bail;

a hollow axle, for containing the auxiliary tissue therein;

an axle end, for attaching the bail to the hollow axle, molded to said hollow axle;

one of a mechanical or an adhesive mounting system for connecting the axle end to the bail, attached to said axle end, and engaged to said bail;

an access opening formed to said hollow axle;

a finger hole formed to said hollow axle;

the auxiliary tissue, inserted to said axle;

a cap slide formed to said hollow axle; and one of a slip cap or a keeper cap placed atop said cap slide.

* * * * *